US006530106B1

(12) United States Patent
Brundula

(10) Patent No.: US 6,530,106 B1
(45) Date of Patent: Mar. 11, 2003

(54) VACUUM SWEEPER ROLLER BRUSH

(75) Inventor: William P. Brundula, Kirtland, OH (US)

(73) Assignee: Bruns Brush, Inc. (Ohio Corporation), Willoughby, OH (US)

( * ) Notice: Subject to any disclaimer, the term of this patent is extended or adjusted under 35 U.S.C. 154(b) by 0 days.

(21) Appl. No.: 09/512,005

(22) Filed: Feb. 24, 2000

(51) Int. Cl.[7] ..... A46B 7/10

(52) U.S. Cl. ..... 15/182; 15/179; 15/41.1; 15/383

(58) Field of Search ..... 15/41.1, 182, 183, 15/179, 383

(56) References Cited

U.S. PATENT DOCUMENTS

| | | | | | |
|---|---|---|---|---|---|
| 293,989 | A | * | 2/1884 | Travis | 15/41.1 |
| 455,017 | A | * | 6/1891 | Hothersall | 15/179 X |
| 606,248 | A | * | 6/1898 | Smith | 15/182 X |
| 1,624,247 | A | * | 4/1927 | Hoover | 15/179 X |
| 2,045,270 | A | * | 6/1936 | Hoover | 15/183 |
| 2,135,885 | A | * | 11/1938 | Dow | 15/183 |
| 2,140,651 | A | * | 12/1938 | Riebel, Jr. et al. | 15/138 |
| 2,271,556 | A | * | 2/1942 | Boyle et al. | 15/183 |
| 2,459,007 | A | * | 1/1949 | Taylor | 15/383 |
| 2,659,921 | A | * | 11/1953 | Osborn | 15/182 |
| 2,790,985 | A | * | 5/1957 | Harlan | 15/183 |
| 3,482,276 | A | * | 12/1969 | Fillery | 15/41.1 X |
| 3,716,889 | A | * | 2/1973 | Goldstein | 15/383 X |
| 5,495,634 | A | * | 3/1996 | Brundula et al. | 15/182 |

FOREIGN PATENT DOCUMENTS

| | | | | |
|---|---|---|---|---|
| FR | 1377905 | * | 9/1964 | 15/41.1 |

* cited by examiner

*Primary Examiner*—Mark Spisich
(74) *Attorney, Agent, or Firm*—Woodling, Krost and Rust

(57) ABSTRACT

A vacuum sweeper roller brush having tuft segments arranged in straight lines is employed to slap the carpet and dislodge particulate dirt and dust lodged therein. The tuft segments are made up of groups of tufts and each tuft segment has a corresponding tuft segment spaced apart from the first tuft segment. The tuft segments are arranged in a double helix or partially in a first double helix and partially in a second double helix. Alternatively, a single helix may be used. Other embodiments employ tufts which link one tuft segment to another in a stepped pattern or employ tuft segments which link tuft segments together in a helical pattern.

10 Claims, 21 Drawing Sheets

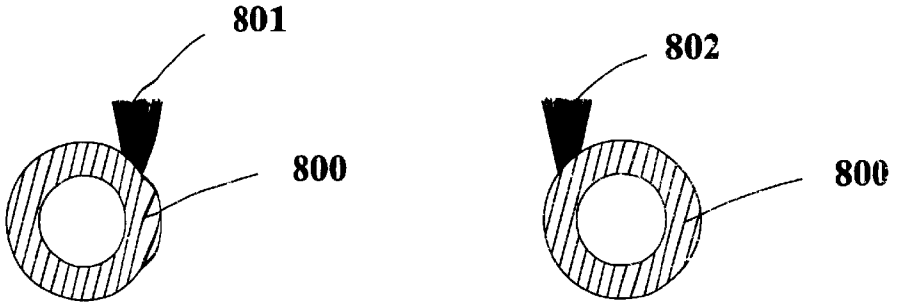
FIG. 8
FIG. 8A
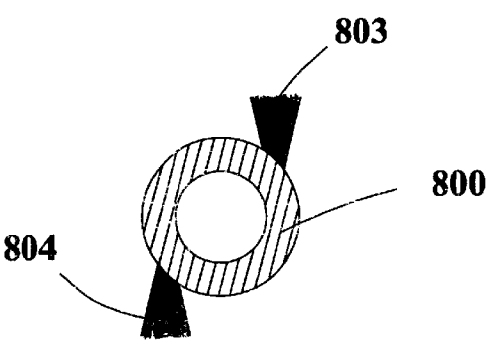
FIG. 8B
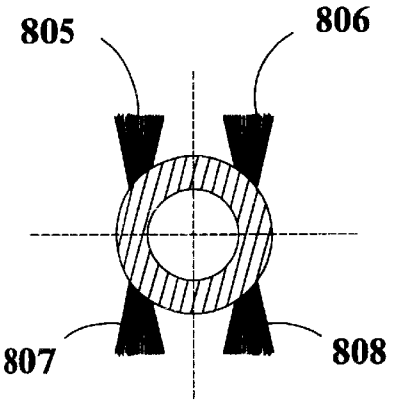
FIG. 8C
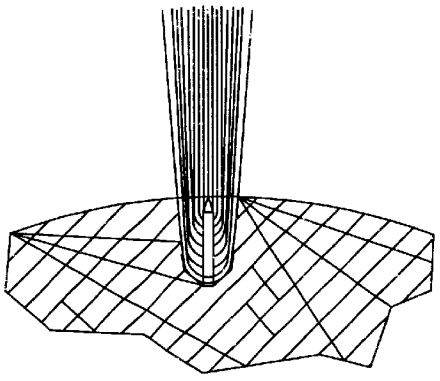
FIG. 9

VACUUM SWEEPER ROLLER BRUSH

FIELD OF THE INVENTION

This invention relates primarily to vacuum sweeper roller brushes. However, it will be appreciated by those skilled in the art that the invention has broader applications and may also be adapted for use in many other environments where a brushroll is utilized.

BACKGROUND OF THE INVENTION

U.S. Pat. No. 5,452,490 to Brundula, et al. discloses a dual roll of bristles, one supporting the other, for improved sweeping performance. U.S. Pat. No. 5,495,634 to Brundula et al. discloses a plurality of brush tufts and stiffener bars used to support the tufts for improved sweeping performance. Sweeping performance is determined by the amount of dirt, dust and debris removed from a surface to be cleaned.

Stiffeners and beater bars add cost and complexity to the brushroll as described in the '490 patent to Brundula, et al.

SUMMARY OF THE INVENTION

A roller brush for use in a vacuum cleaner which has first tuft segments arranged in straight lines is disclosed. The roller brush may be made of wood, plastic, metal or any combination thereof Each tuft segment comprises groups of tufts. Tufts are sometimes referred to as bristles. The bristles/tufts can be of any suitable material either man-made or natural. One such material is nylon. The tufts/bristles are secured in holes in the roller brush and the holes in the roller brush are filled with as many bristles as will fit in them. The bristles may be angled in one or the other longitudinal directions.

Tuft segments which correspond to the first tuft segments are arranged in straight lines and are located in the roller brush at a point 180 degrees from the first tuft segments. The tuft segments may be arranged in a single or dual helix or in another arrangement. It should be noted that the helical arrangement of the tuft segments is done step-wise with spaces or gaps in between the tuft segments. For instance, a portion of the roller brush may employ a dual helix comprised of straight line segments and the remainder of the roller brush may include two partial dual helixes.

Alternatively, the tuft segments may be oriented in the direction of the helix with gaps or spaces such that the helix is not continuous. Further, the tuft segments may be oriented off-center, for example, not radially oriented.

Alternatively, the tufts segments may be linked by one or more tufts or tuft segments. A stepped pattern or a helical pattern may be formed by the linking tufts and/or the linking tufts segments.

The tuft segments comprise groups of tufts or bristles. Four, three, or two group tuft segments or any combination thereof may be employed. Longitudinal and angular gaps between the tuft segments exist in some embodiments. In other embodiments, the tuft segments are linked by one or more tufts and/or tuft segments. Tufts from the tuft segments form, in part, a linking tuft segment.

It is an object of the present invention to provide a brush roll which slaps the surface to be cleaned. Slapping is accomplished by the orientation of groups of tufts spaced longitudinally and angularly from each other. Longitudinal and angular spacing provides room for the agitated dirt, dust and debris to be removed by the suction of the vacuum pump. In those embodiments employing linking tufts or tuft segments, the continuity of the tuft pattern facilitates the removal of dirt, dust and debris by directing it to the suction of a vacuum pump.

It is an object of the present invention to provide a brush roll which does not employ a stiffener or a beater bar.

It is an object of the present invention to provide a brush roll which can be driven by a belt in its middle or at its ends.

It is an object of the present invention to provide a brush roll which can be supported by conventional bearings.

Still other advantages, benefits and objects of the present invention will become more readily apparent to those skilled in the art upon a reading and understanding of the following drawings and description which follows hereinbelow.

BRIEF DESCRIPTION OF THE DRAWINGS

FIGS. 8, 8A, 8B, and 8C are cross-sectional views of other embodiments of the roller brush illustrating tufts which are not radially oriented.

FIG. 9 illustrates the attachment of one tuft to the roller brush.

A better understanding of the drawings will be had when the following Description Of The Invention is read and understood.

DESCRIPTION OF THE INVENTION

Figure 1:
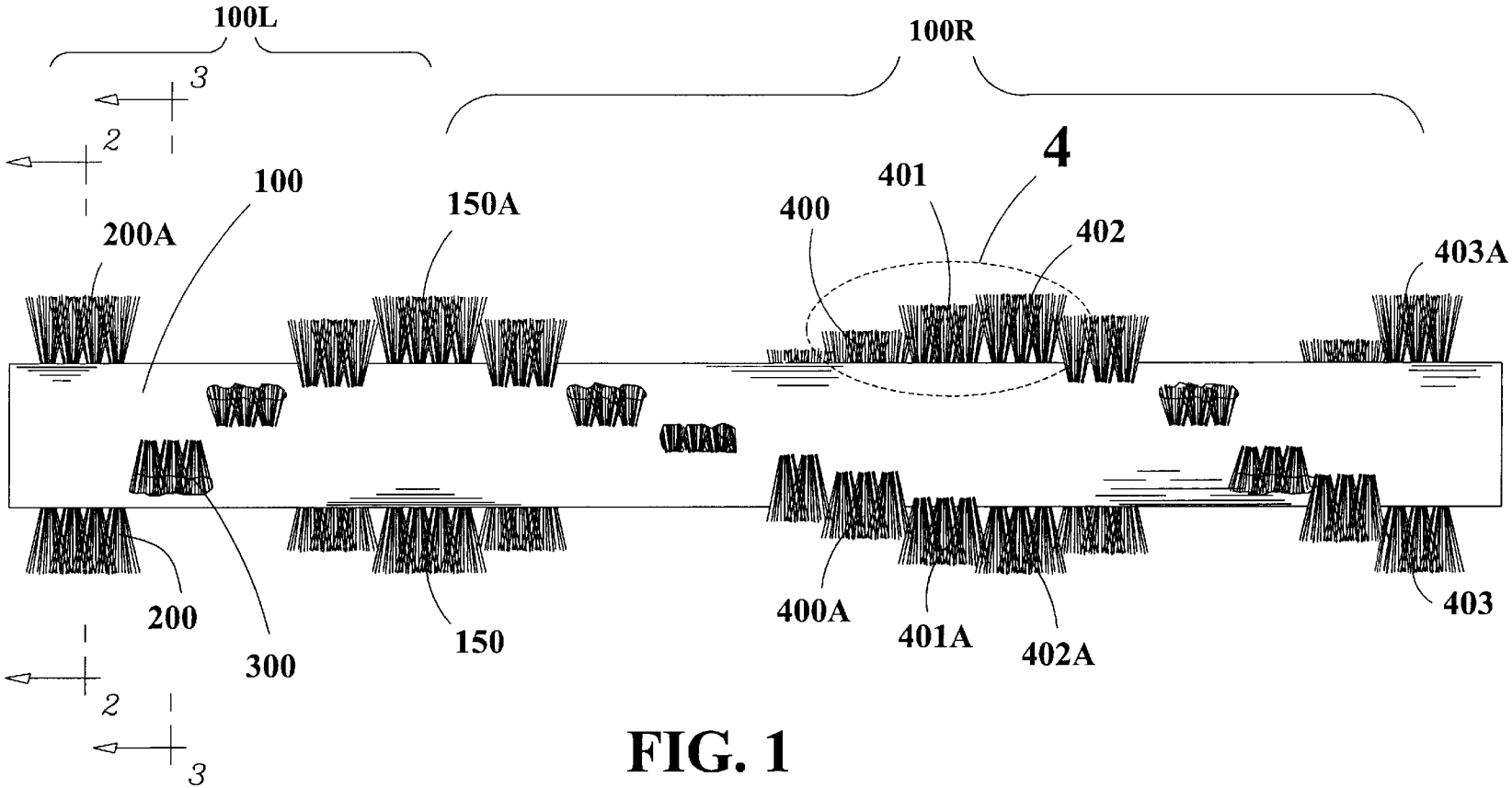
FIG. 1 is a front plan view of the roller brush illustrating tuft segments helically oriented. There are two double helixes, one double helix beginning from the left side and one beginning from the right side.

Referring now to the drawings, wherein the showings are for purposes of illustrating several embodiments of the invention only and not for purposes of limiting same, FIG. 1 is a front plan view of the roller brush 100 illustrating tuft segments (i.e., tuft segments 200, 300) helically oriented.

Roller brush 100 is illustrated in FIG. 1 with segmented tufts. Each segment of tufts is oriented perpendicularly to a tangent on the surface of the roller brush 100. Put another way, the tuft segments are radially oriented. Tuft segment 200 is illustrated and comprises four tufts. Tuft segment 200A is located 180 degrees away from tuft segment 200. Tuft segment 300 is comprised of three tufts. There is a corresponding tuft segment to tuft segment 300 located 180 degrees from tuft segment 300 but it is not illustrated in FIG. 1 as FIG. 1 is a front plan view. The instant invention contemplates corresponding tuft segments placed at other angles such as 120 degrees from each other.

Figure 2:
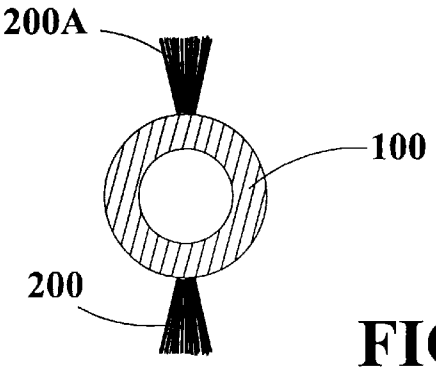
FIG. 2 is a cross-sectional view of the roller brush illustrated in FIG. 1 taken along the lines 2—2 illustrating tuft segments 180 degrees apart.

FIG. 2 is a cross-sectional view of the roller brush illustrated in FIG. 1 taken along the lines 2—2 and indicates the 180 degree relationship between tuft segment 200 and tuft segment 200A.

Figure 3:
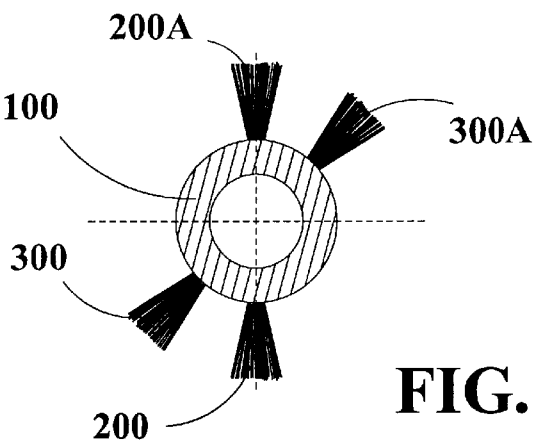
FIG. 3 is a cross-sectional view of the roller brush illustrated in FIG. 1 taken along the lines 3—3 illustrating tuft segments 180 degrees apart.

FIG. 3 is a cross-sectional view of the roller brush illustrated in FIG. 1 taken along the lines 3—3. In this view tuft segment 300 is shown along with corresponding tuft segment 300A. The 180 degree spacing between tuft segments is obvious when viewing FIG. 3. It will be noted that tufts segments 200 and 200A comprise four tufts while tuft segments 300 and 300A comprise three tufts. It will be further noted that there is an angular space of 180 degrees between tuft segments 200 and 200A and 300 and 300A. This angular space does not include any tufts. Further, there is a longitudinal space between tufts 200 and 300. In this embodiment, dirt, dust and debris agitated by the tuft segments are suspended in the air space between the tuft segments until they are removed by the vacuum pump.

FIG. 1 illustrates a left portion 100L of the roller brush 100 and a right portion 100R of the roller brush 100. The right portion 100R of the roller brush comprises a dual helix. Tuft segment 403 and tuft segment 403A represent the beginning of the dual helix of the right portions 100R. The dual helix continues throughout the right portion 100R of the roller brush and into 100L, the left portion of the roller brush 100. Tuft segments 150 and 150A represent the end of the dual helix which began with tuft segments 403 and 403A. Another dual helix starts with tuft segments 200 and 200A and they extend up to and including tuft segments 150 and 150A. Tuft segments 150 and 150A are the ends of all four helixes.

FIG. 1 also illustrates tuft segments 400, 401 and 402 as well as corresponding tuft segments 400A, 401A and 402A which are, as stated previously, 180 degrees apart.

Figure 1A:
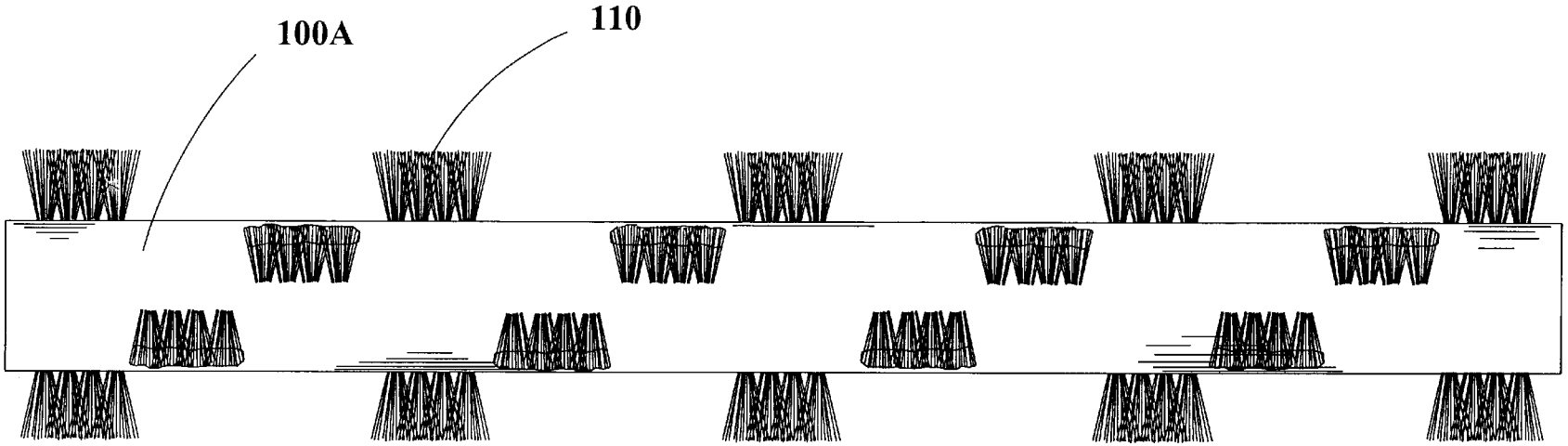
FIG. 1A is a front plan view of another roller brush illustrating tuft segments helically oriented with each tuft segment having four tufts.
Figure 1B:
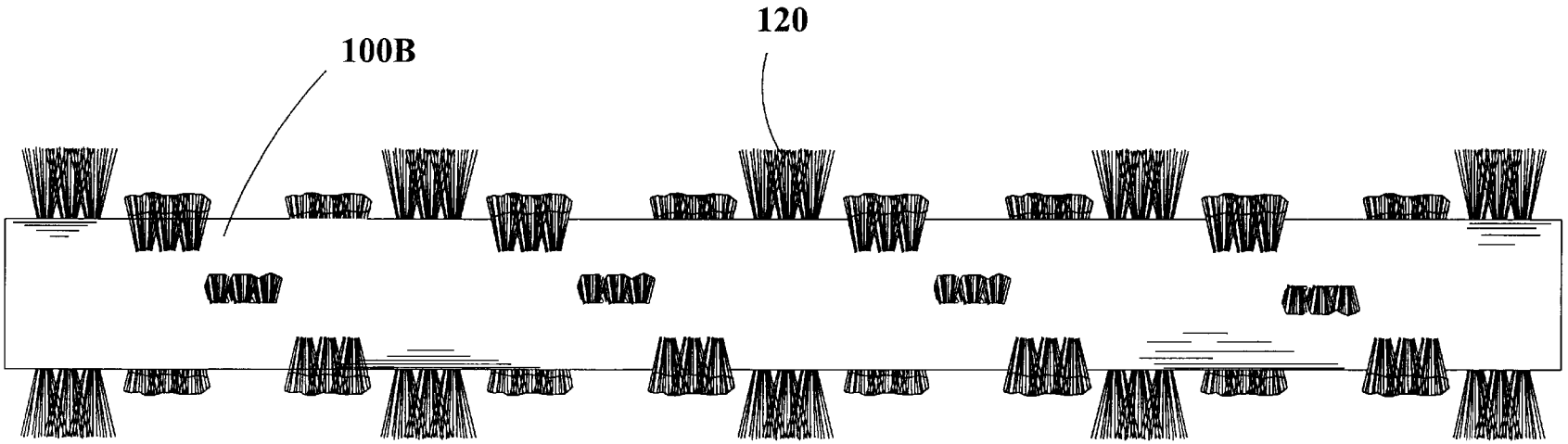
FIG. 1B is a front plan view of another roller brush illustrating tuft segments helically oriented with each segment having three tufts.
Figure 1C:
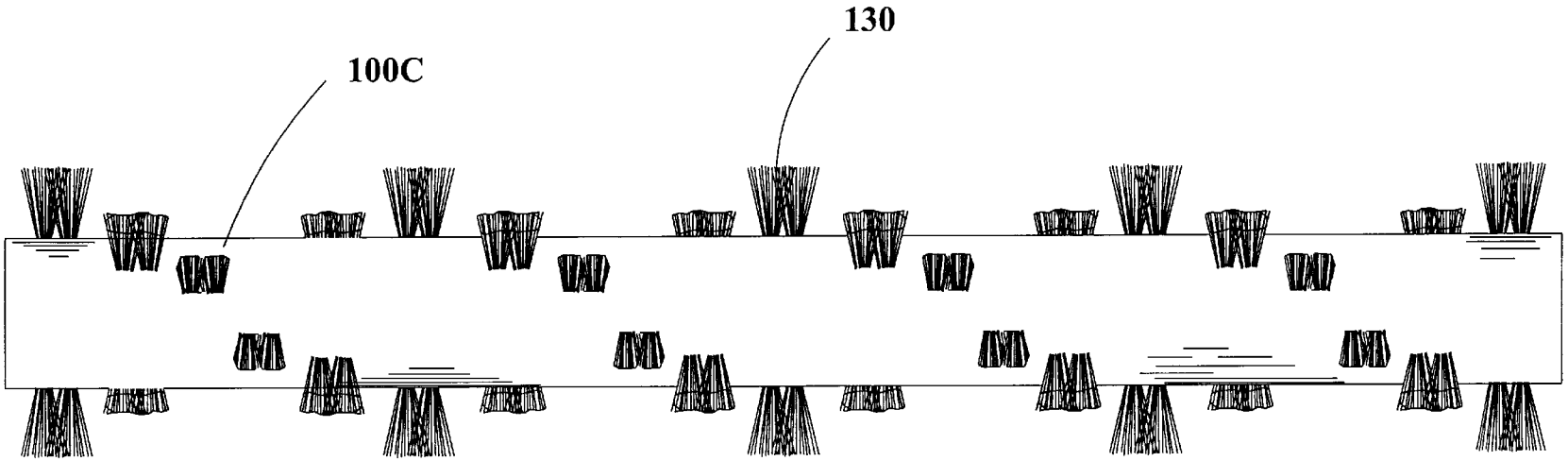
FIG. 1C is a front plan view of another roller brush illustrating tuft segments helically oriented with each tuft segment having two tufts.

FIG. 1A is a front plan view of another roller brush 100A illustrating tuft segments 110 helically oriented with each tuft segment 110 having four tufts. FIG. 1B is a front plan view of another roller brush 100B illustrating tuft segments 120 helically oriented with each segment 120 having three tufts. FIG. 1C is a front plan view of another roller brush illustrating another roller brush 100C with tuft segments 130 helically oriented with each tuft segment having two tufts.

Figure 1D:
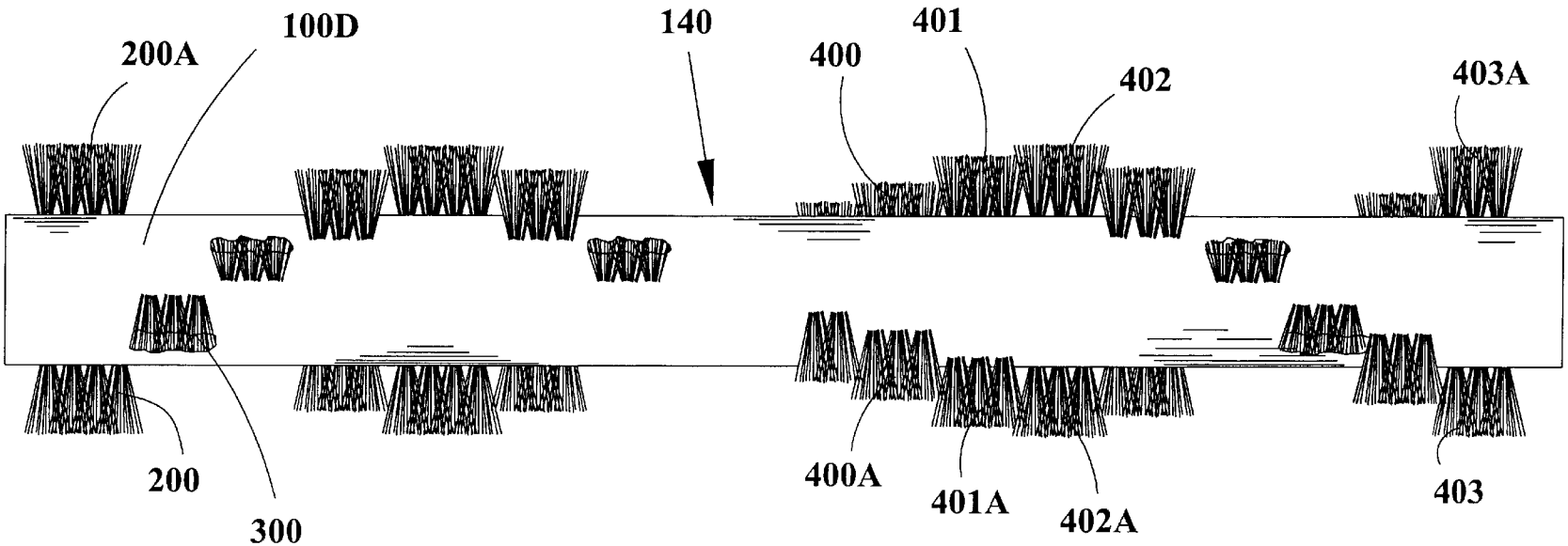
FIG. 1D is a front plan view of a roller brush similar to FIG. 1 illustrating a gap located in the middle portion of the brush which may be adapted for driving the roller brush.

FIG. 1D is a front plan view of the roller brush 100D similar to FIG. 1 illustrating a gap 140 located in the middle portion of the brush 100D. This gap may be used or adapted to receive a driving mechanism or means to rotate the roller brush. All of the roller brushes illustrated are adapted for rotation in a vacuum cleaner or other cleaning device .

Figure 1E:
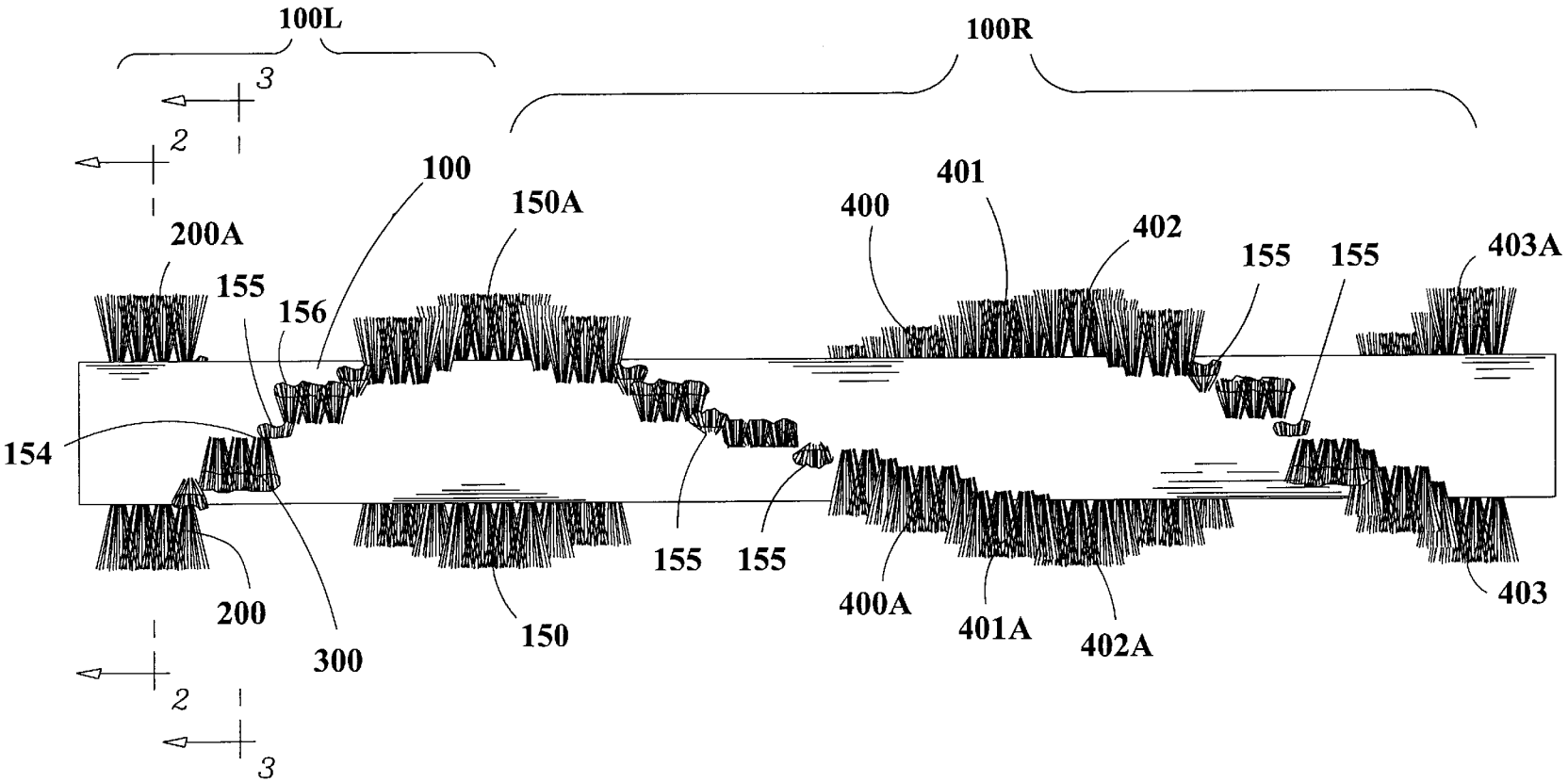
FIG. 1E is a front plan view of a roller brush similar to FIG. 1 wherein tufts are placed intermediate tuft segments so as to link the segments together.

FIG. 1E is a front plan view of a roller brush similar to FIG. 1 wherein tufts 155 are placed intermediate tuft segments so as to link the segments together. The tufts 155 create a stepped pattern of tuft segments. Tufts 155 link the other tuft segments and form tuft segments which are oriented helically in a stepped pattern. For instance, tuft 155, sometimes referred to herein as a linking tuft, connects or links tufts 154 and 156 together in a stepped pattern of tuft segments. Tufts 154, 155 and 156 form another tuft segment which is located at an angle with respect to the tuft segments thereby joined.

Figure 4:
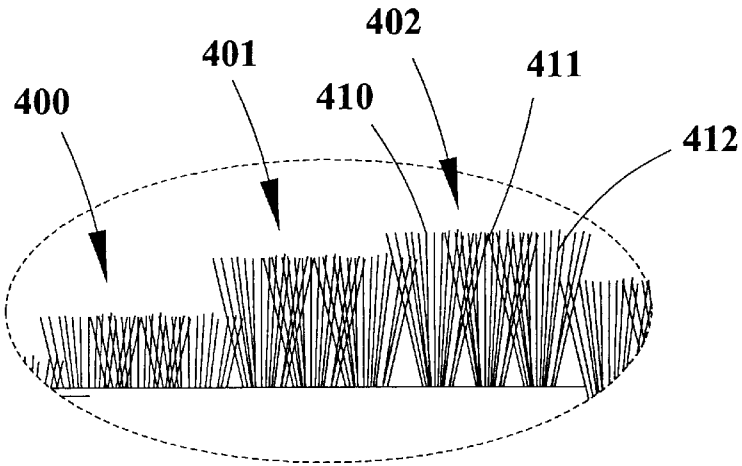
FIG. 4 is an enlarged portion of FIG. 1 illustrating some of the tuft segments of FIG. 1.

FIG. 4 is an enlarged portion of FIG. 1 illustrating the tuft segments 400, 401 and 402 of FIG. 1. Each tuft segment, for example tuft segment 402, includes three tufts 410, 411 and 412.

Figure 5:
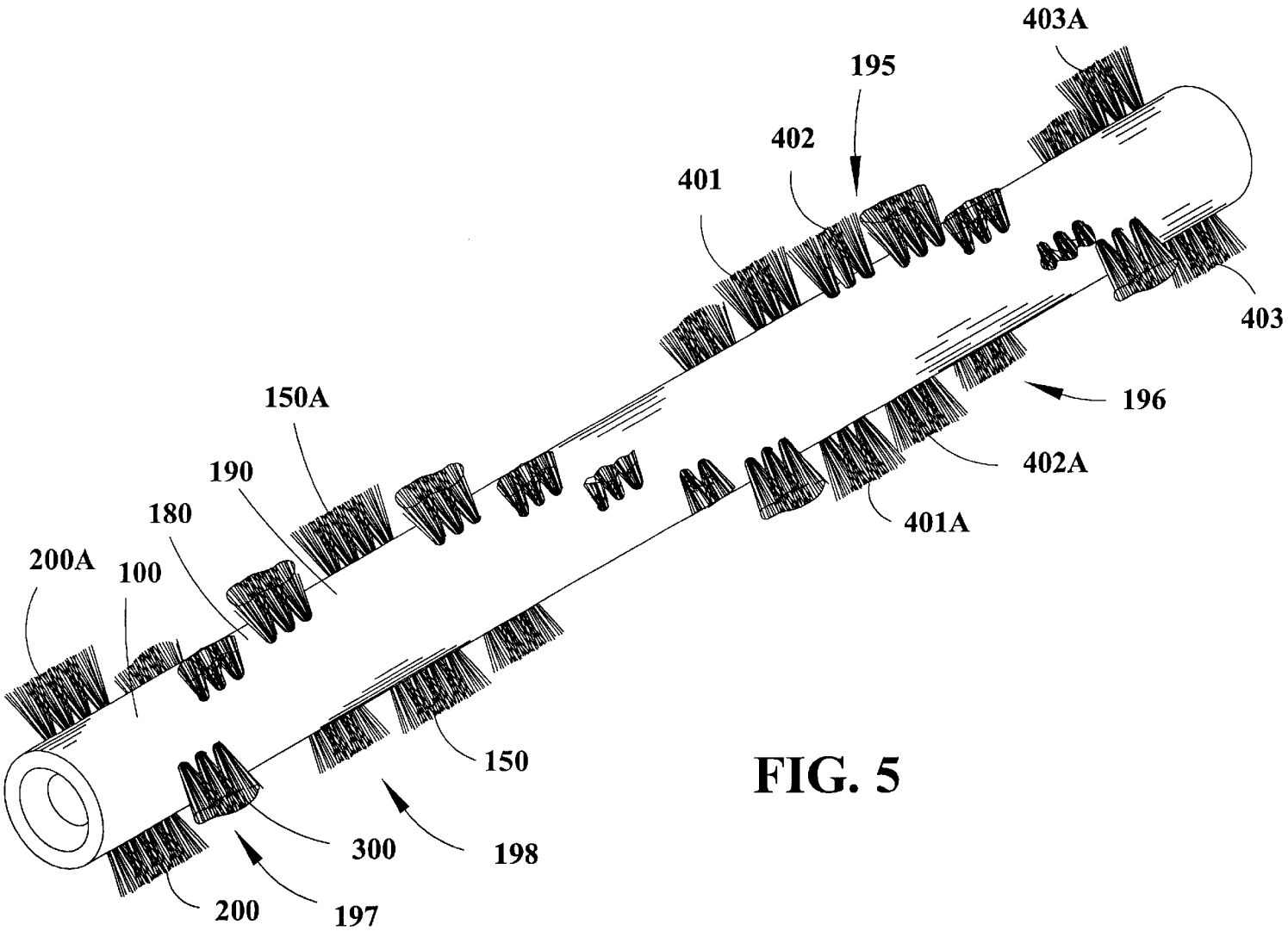
FIG. 5 is a perspective view of FIG. 1.

FIG. 5 is a perspective view of FIG. 1. FIG. 5 illustrates the double helix 195, 196 starting with tuft segments 403 and 403A and terminating with tuft segments 150 and 150A. The second double helix 197, 198 beginning with tuft segments 200 and 200A are also illustrated in FIG. 5. FIG. 5 does a particularly good job at illustrating the longitudinal axis of the roller brush 100. Longitudinal gaps represented by reference numerals 180 and 190, for instance, are well illustrated in FIG. 5.

Figure 5A:
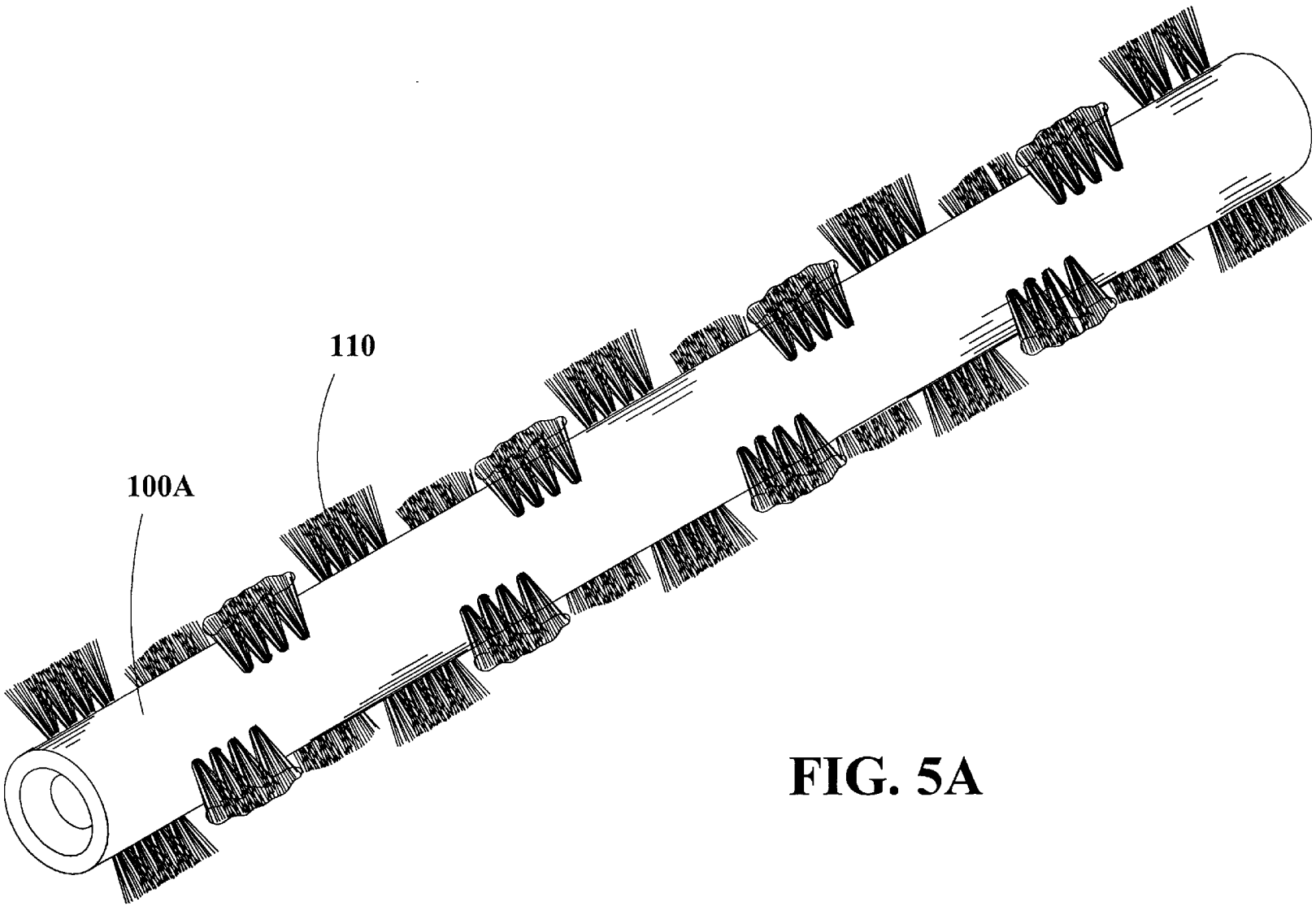
FIG. 5A is a perspective view of FIG. 1A.

FIG. 5A is a perspective view of roller brush 100A. FIG. 5A illustrates a roller brush having a double helix with tuft segments 110 each having four tufts.

Figure 5B:
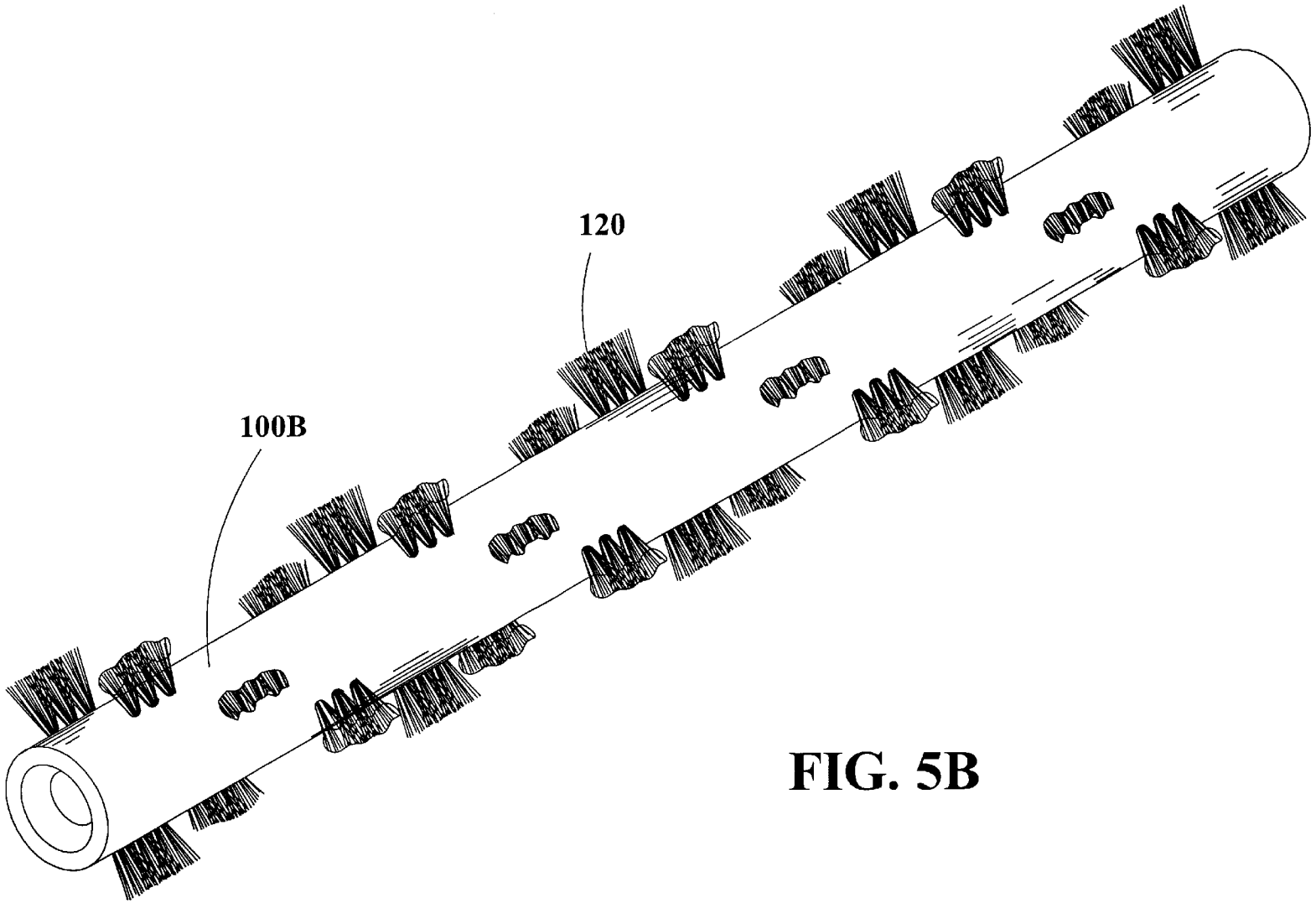
FIG. 5B is a perspective view of FIG. 1B.
Figure 5C:
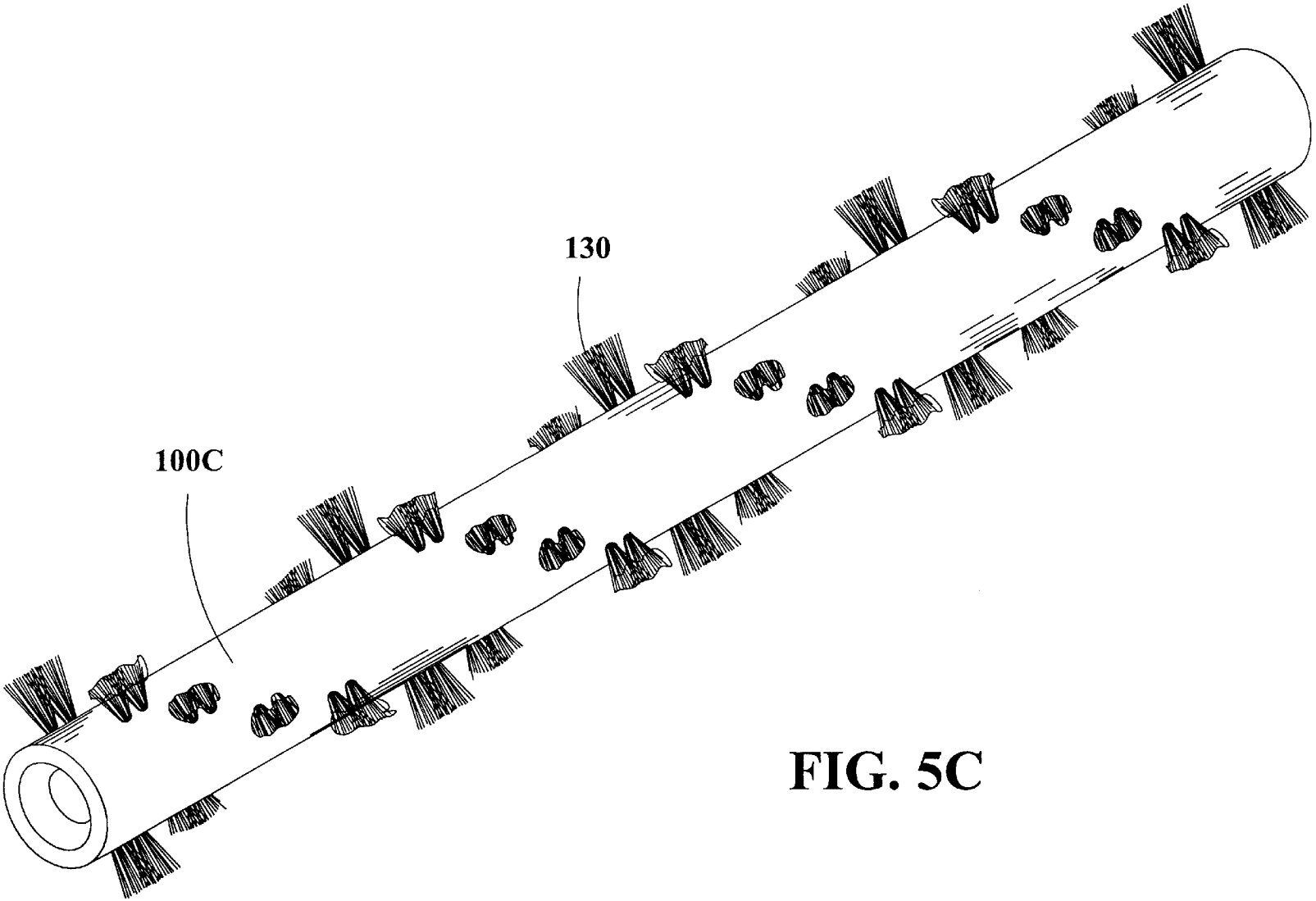
FIG. 5C is a perspective view of FIG. 1C.

FIG. 5B is a perspective view of FIG. 1B. FIG. 5B illustrates a double helix with tuft segments 120 each having three tufts. FIG. 5C is a perspective view of FIG. 1C illustrating roller brush 100C and tuft segments 130. Each tuft segment 130 has two tufts. In FIGS. 5A, 5B, and 5C each tuft segment shown includes a tuft segment 180 degrees apart therefrom. Additionally each tuft segment is spaced longitudinally from its adjacent tuft segment so as to provide space for the agitated dirt, dust and debris to become airborne for evacuation by the vacuum pump of the vacuum cleaner (not shown).

Figure 6:
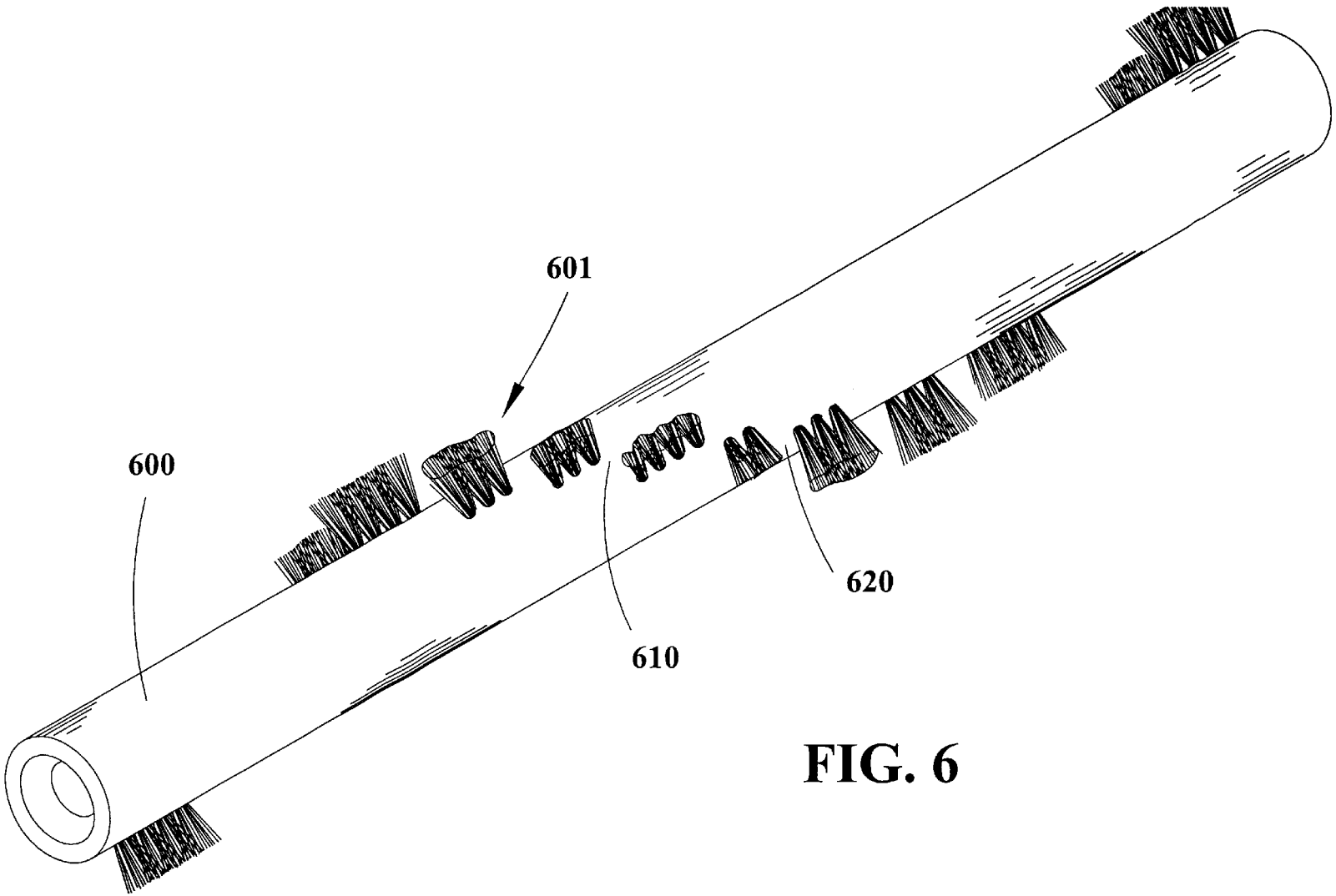
FIG. 6 is a perspective view of a roller brush illustrating tuft segments helically oriented in a single helix.

FIG. 6 is a perspective view of a roller brush 600 illustrating tuft segments 601 helically oriented in a single helix 601. The tuft segments of roller brush 600 are aligned in straight rows and may comprise either four, three, or two tufts. Longitudinal spaces between the tuft segments can be seen by reference numerals 610 and 620.

Figure 6A:
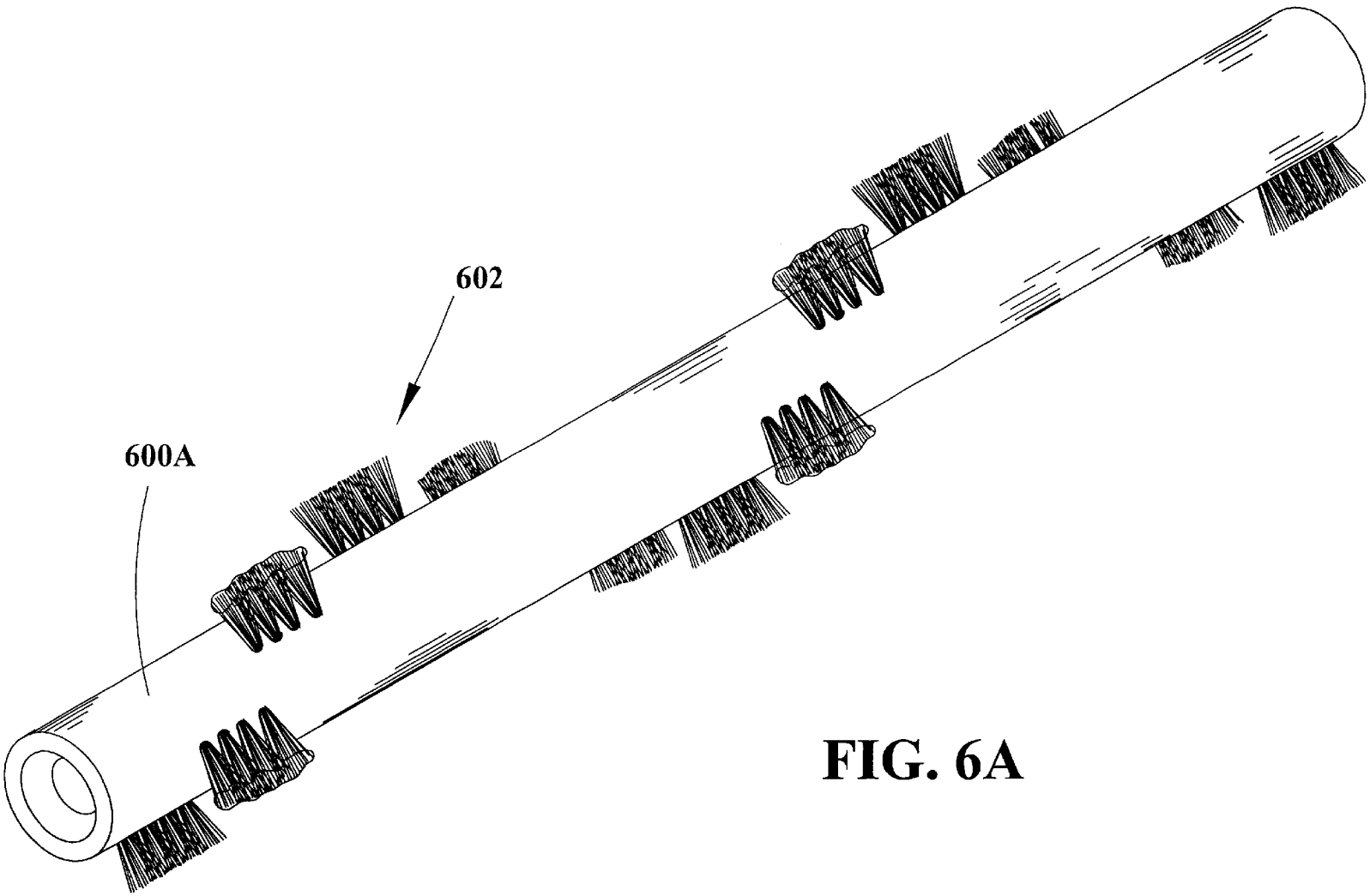
FIG. 6A is a perspective view of a roller brush illustrating tuft segments helically oriented in a single helix with each segment having four tufts.

FIG. 6A is a perspective view of a roller brush 600A illustrating tuft segments helically oriented in a single helix with each segment having four tufts. Reference numeral 602 generally indicates the single helix. The embodiments illustrated in FIGS. 6, 6A, 6B and 6C are single helixes meaning there is not a corresponding tuft segment 180 degrees apart from the tuft segments illustrated.

Figure 6B:
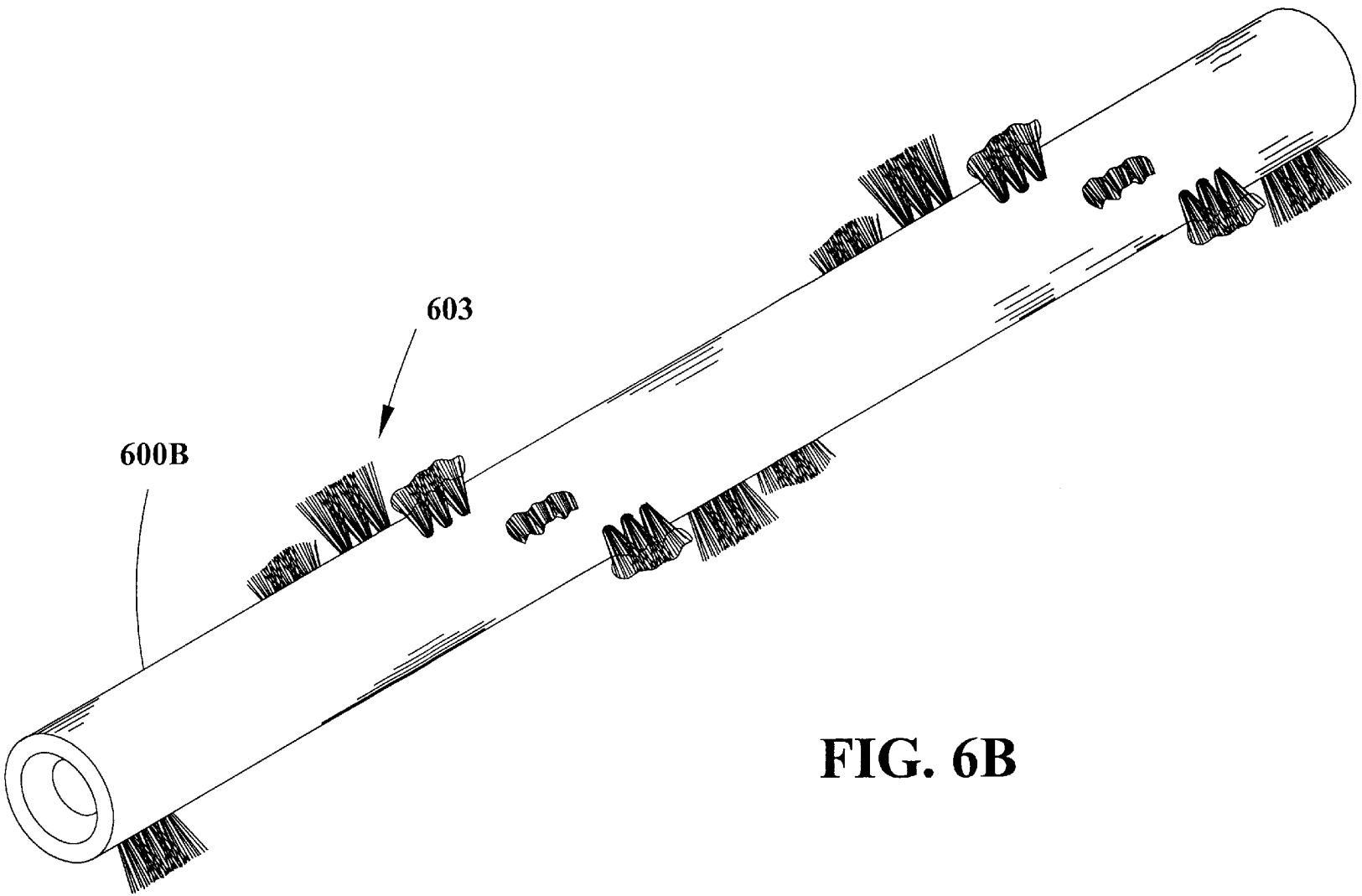
FIG. 6B is a perspective view of a roller brush illustrating tuft segments helically oriented with each segment having three tufts.
Figure 6C:
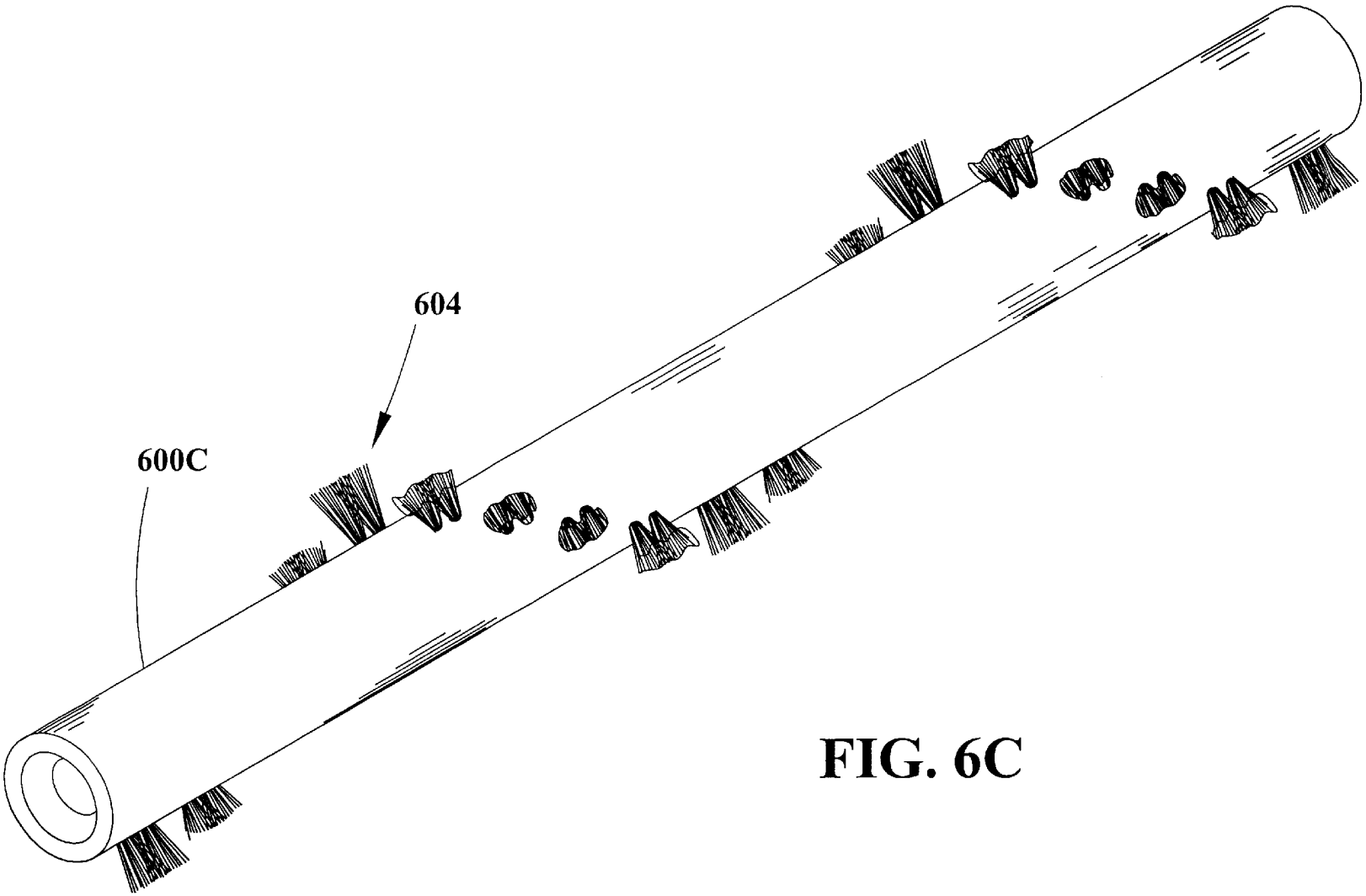
FIG. 6C is a perspective view of a roller brush illustrating tuft segments helically oriented with each segment having two tufts.

FIG. 6B is a perspective view of a roller brush 600B illustrating tuft segments helically oriented with each segment having three tufts. Reference numeral 603 indicates the single helix. FIG. 6C is a perspective view of a roller brush 600C illustrating tuft segments helically oriented as indicated by reference numeral 604 with each segment having two tufts.

Figure 7:
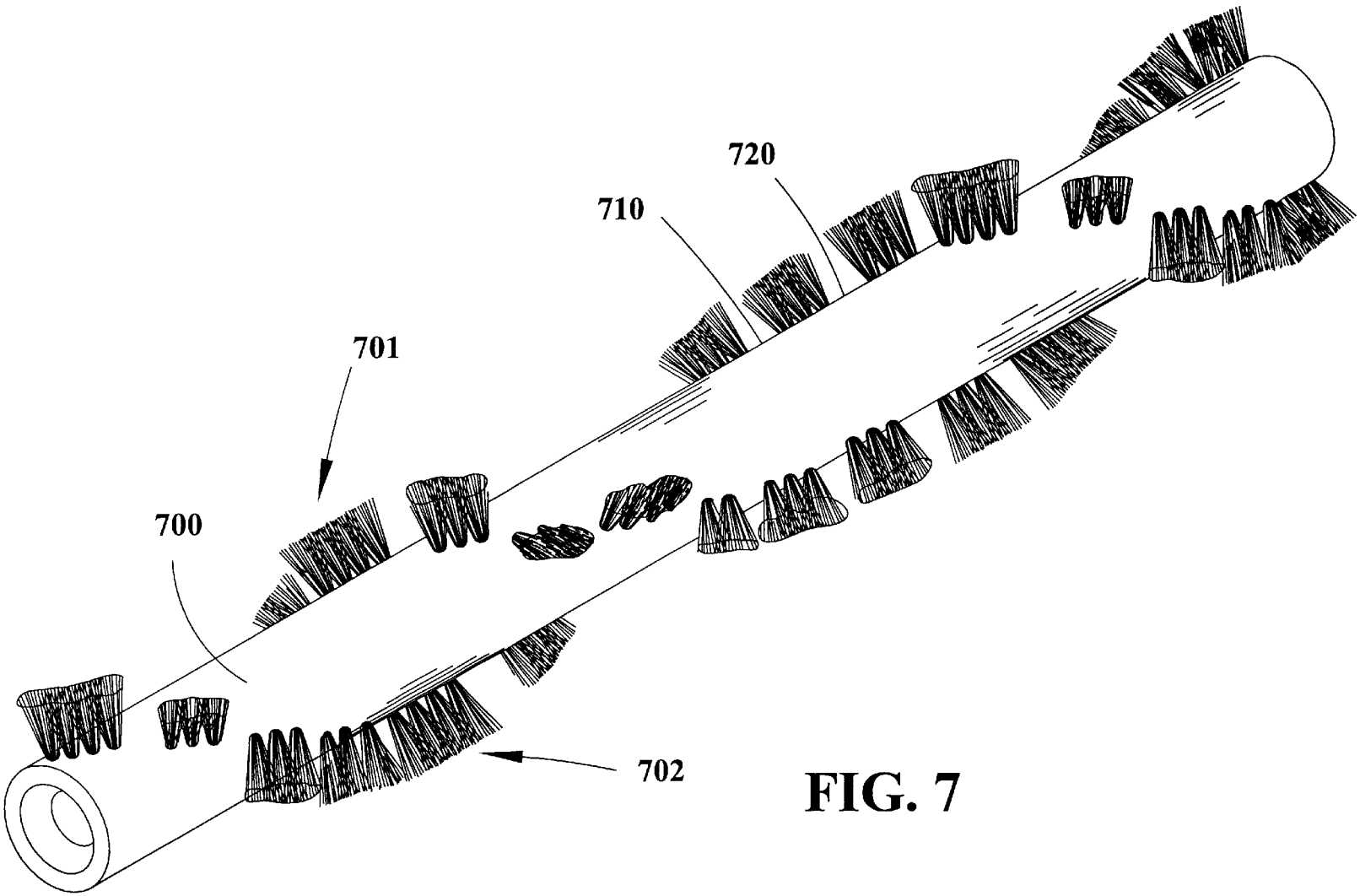
FIG. 7 is a perspective view of a roller brush illustrating tuft segments helically oriented with each segment aligned in a double helix.

FIG. 7 is a perspective view of a roller brush 700 illustrating tuft segments helically oriented with each segment aligned in a double helix 701, 702. Longitudinal gaps or spaces 710 and 720 are illustrated. In this embodiment the tuft segments have either four, three, or two tufts in each segment and they are spaced rotationally or angularly 180 degrees apart. Spacing of the tufts in this embodiment provide good sweeping performance.

Figure 7A:
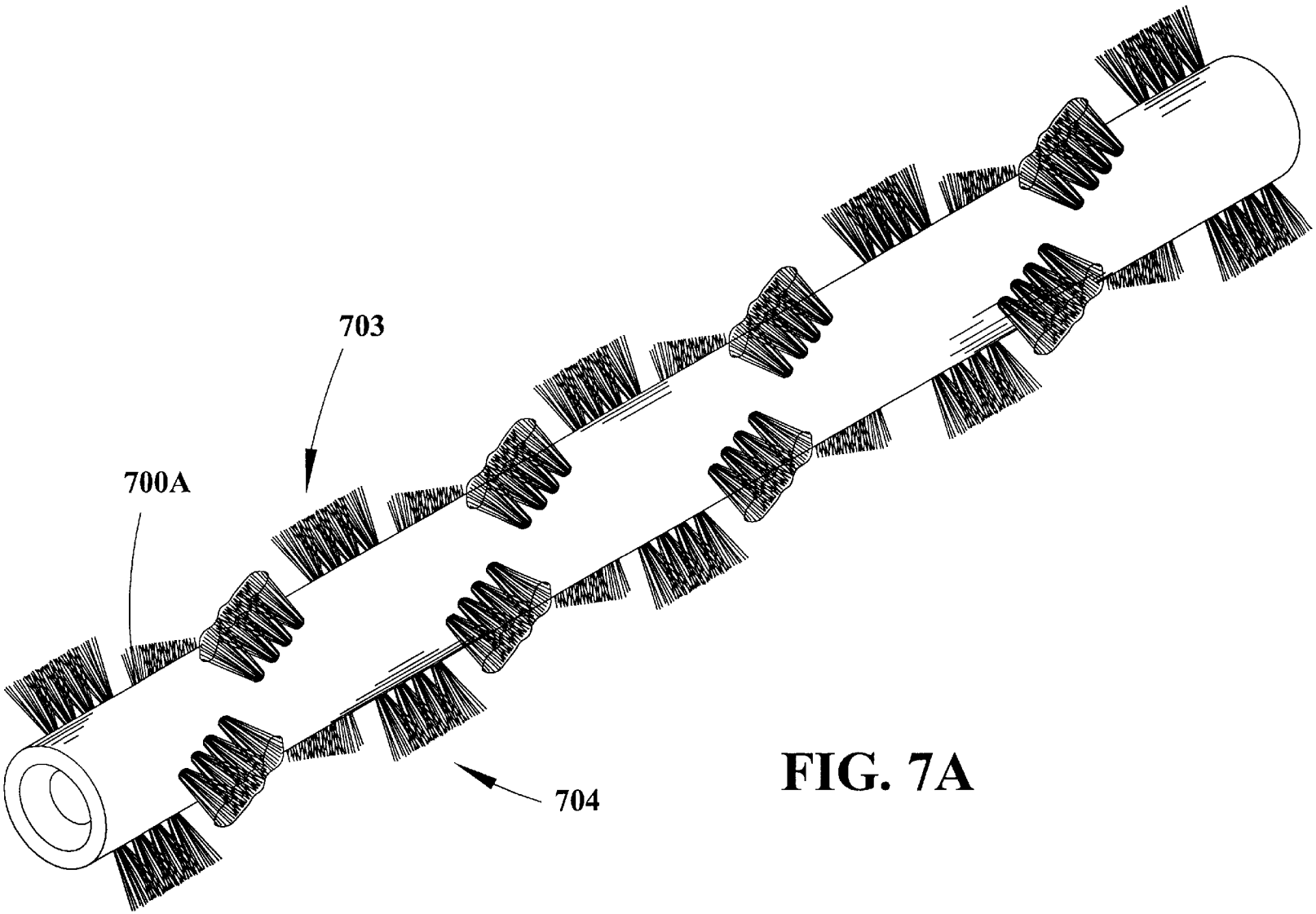
FIG. 7A is a perspective view of a roller brush illustrating tuft segments helically oriented with each segment of tufts aligned on a double helix similar to FIG. 7 except each segment includes four tufts.

FIG. 7A is a perspective view of a roller brush 700A illustrating tuft segments helically oriented with each segment of tufts aligned on a double helix similar to FIG. 7 except each segment includes four tufts. The helixes are indicated by reference numerals 703 and 704.

Figure 7B:
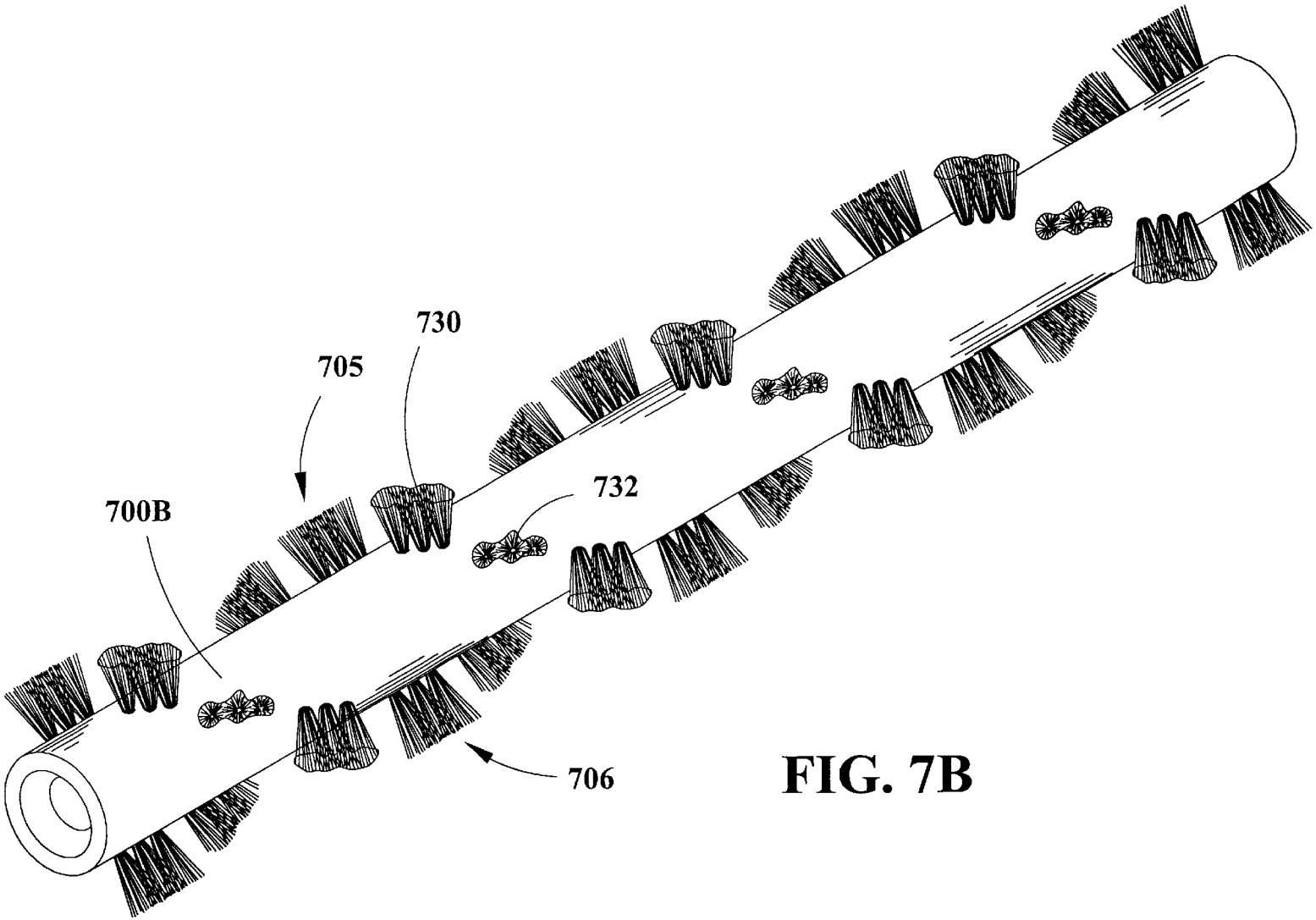
FIG. 7B is a perspective view of a roller brush illustrating tuft segments helically oriented with each segment of tufts aligned in a double helix similar to FIGS. 7 and 7A except each segment includes three tufts.

FIG. 7B is a perspective view of a roller brush 700B illustrating tuft segments helically oriented with each segment of tufts aligned in a double helix similar to FIGS. 7 and 7A, except each segment includes three tufts. Here, in FIG. 7B, reference numeral 705 and 706 indicate the helixes. Unnumbered longitudinal spaces are evident from FIGS. 7, 7A, 7B and 7C.

Figure 7C:
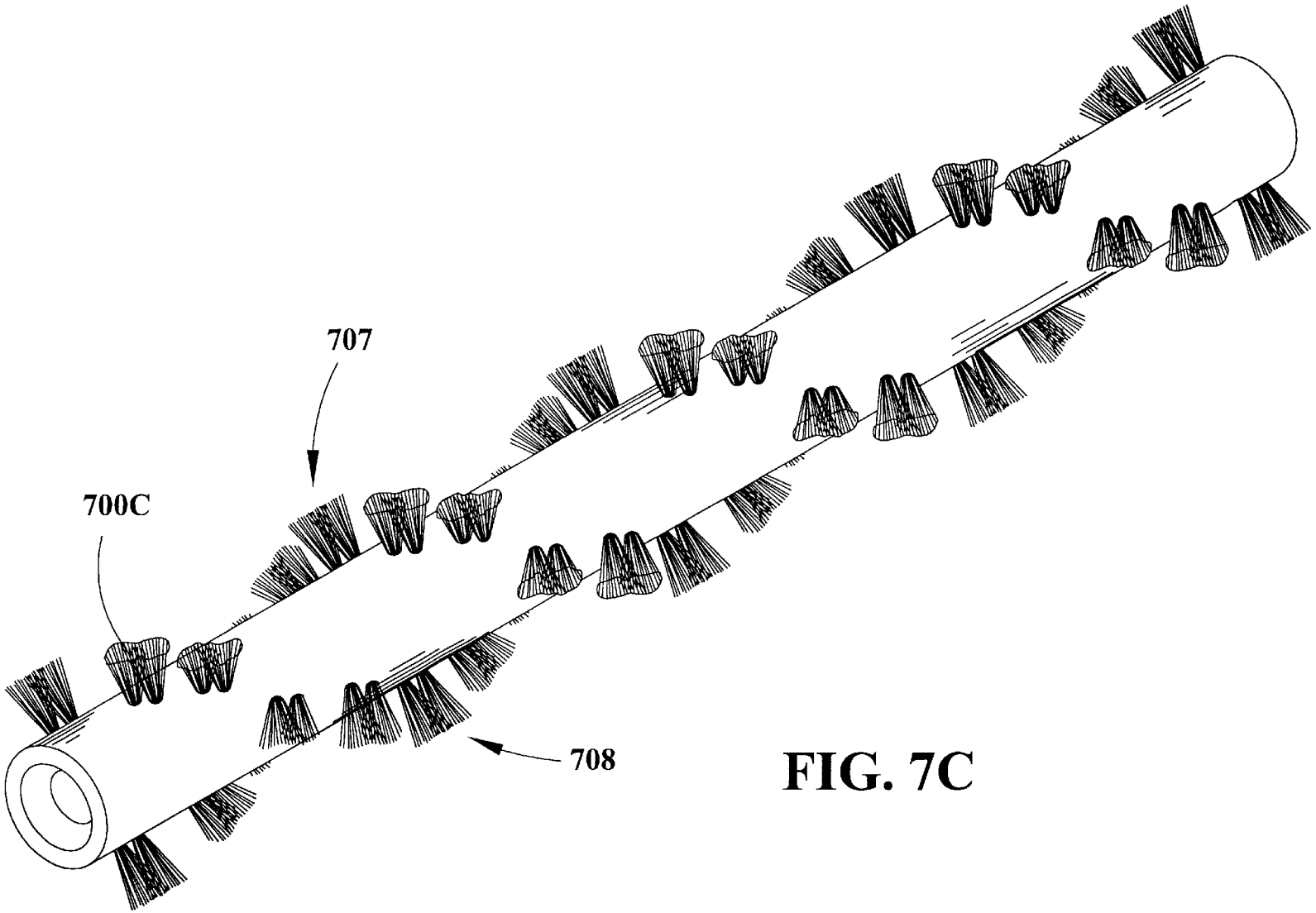
FIG. 7C is a perspective view of a roller brush illustrating tuft segments helically oriented with each segment of tufts aligned in a double helix similar to FIGS. 7, 7A and 7B except each segment includes two tufts.

FIG. 7C is a perspective view of a roller brush 700C illustrating tuft segments helically oriented with each segment of tufts aligned in a double helix similar to FIGS. 7, 7A and 7B except each segment includes two tufts. Reference numeral 707 and 708 illustrate the helixes.

Figure 7D:
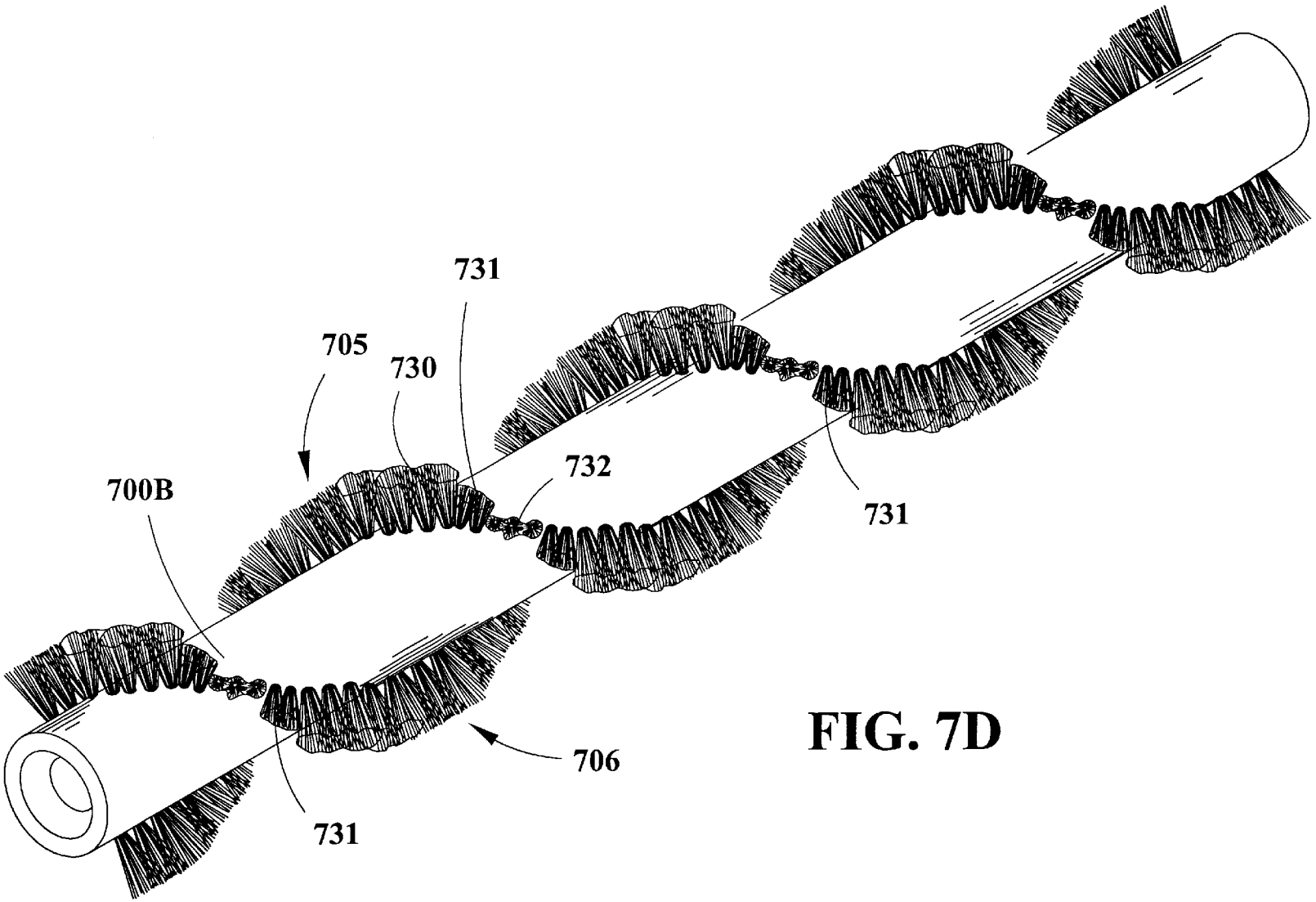
FIG. 7D is a perspective view of a roller brush illustrating tuft segments helically oriented with each segment of tufts aligned in a double helix similar to FIGS. 7 and 7A except each segment includes three tufts and each segment is linked to the next segment by intermediate tufts.

FIG. 7D is a perspective view of a roller brush illustrating tuft segments helically oriented with each segment of tufts aligned in a double helix similar to FIGS. 7 and 7A except each segment includes three tufts and each segment is linked to the next segment by an intermediate tuft. For instance, tuft segment 730 is linked to tuft segment 732 by tuft segment 731. Tuft segment 731 is sometimes referred to herein as a linking tuft segment and it comprises two tufts. Tufts of segments 730 and 732 in effect form part of a tuft segment.

FIGS. 8, 8A, 8B and 8C are cross-sectional views of other embodiments of the roller brush illustrating tuft segments which are not radially oriented. It is expressly contemplated within this invention that the tufts be oriented off-center. The orientation of the tufts off center will create a slapping action of the surface to be cleaned. Roller brush 800 is shown with tufts 801, 802, 803, 804, 805, 806, 807, and 808 illustrated in various embodiments of off-center tufts.

Referring again to FIG. 5, the roller brush 100 is supported by bearings which may be inserted into the ends of the roller brush. The brush may be driven by either of its ends or it may be driven in its center. If it is driven in its center, the embodiment illustrated in FIG. 1D must be used. The tufts are sometimes referred to in the art as bristles and they can be made of any suitable material either man-made or natural. One such material is nylon. The tufts/bristles are secured in holes in the roller brush and the holes are filled with as many bristles as will fit in them.

FIG. 9 illustrates the attachment of bristles or tufts to a wooden roller brush. The wooden roller brush may alternately be made of plastic or metal.

The foregoing invention has been described by way of example only. Other embodiments and changes can and will be made without departing from the spirit and scope of the claims which follow hereinbelow.

I claim:

1. A roller brush for use in a vacuum cleaner comprising:

an elongated roller defining a longitudinal axis;

a plurality of tuft segments, each of said tuft segments including at least two tufts, said tufts within each of said tuft segments being spaced by a first distance with each said tuft segment further spaced from the adjacent segment a second distance greater than said first distance;

each of said tuft segments being linearly arranged such that they extend in a direction parallel to the longitudinal axis of said roller; and, said tuft segments are arranged in a double helix on a first portion of said roller and are arranged in another double helix on a second portion of said roller.

2. A roller brush as claimed in claim 1 wherein each tuft segment comprises four tufts.

3. A roller brush as claimed in claim 1 wherein each tuft segment comprises three tufts.

4. A roller brush as claimed in claim 1 wherein each tuft segment comprises two tufts.

5. A roller brush as claimed in claim 1 wherein a gap exists between said first and second portions of said roller.

6. A roller brush as claimed in claim 1 wherein said tuft segments are oriented off-center relative to the axis of the said roller.

7. A roller brush for use in a vacuum cleaner as claimed in claim 1 wherein said first portion of said roller is shorter than said second portion of said roller.

8. A roller brush for use in a vacuum cleaner as claimed in claim 1 wherein both said helixes end with the same two tuft segments.

9. A roller brush for use in a vacuum cleaner comprising:

an elongated roller defining a longitudinal axis;

a plurality of first tuft segments, each of said first tuft segments including at least two tufts, said tufts within each of said first tuft segments being spaced by a first distance with each said first tuft segment further spaced from the adjacent first tuft segment a second distance greater than said first distance;

a plurality of second tuft segments each of said second tuft segments including at least two tufts, said tufts within each of said second tuft segments being spaced by a first distance with each said second tuft segment further spaced from the adjacent second tuft segment a second distance greater than said first distance;

each of said first tuft segments linearly arranged such that they extend in direction parallel to the longitudinal axis of said roller;

said second tuft segments linearly arranged such that they extend in a direction parallel to the longitudinal axis of said roller and each of said second tuft segments being oriented 180 degrees from a respective one of said first tuft segments; and, said first and second tuft segments are arranged to define a double helix on a first portion of said roller and are arranged to define another double helix on a second portion of said roller.

10. A roller brush for use in a vacuum cleaner as claimed in claim 9 wherein both said helixes end with the same two tuft segments.

* * * * *